US006759966B1

(12) United States Patent
Weng

(10) Patent No.: US 6,759,966 B1
(45) Date of Patent: Jul. 6, 2004

(54) WIRELESS REMOTE CONTROL BULB DEVICE

(75) Inventor: Linsong Weng, Chu-Pei (TW)

(73) Assignees: Linsong Weng, Chu-Pei (TW); Hugewin Electronics Co., Ltd., Chu-Pei (TW)

( * ) Notice: Subject to any disclaimer, the term of this patent is extended or adjusted under 35 U.S.C. 154(b) by 390 days.

(21) Appl. No.: 09/653,308

(22) Filed: Sep. 1, 2000

(51) Int. Cl.[7] ..... G08C 19/00
(52) U.S. Cl. ..... 340/825.69; 315/291; 362/251
(58) Field of Search ..... 340/825.69, 825.72, 340/310.01, 310.02, 825.53, 825.22, 539, 825.52; 341/173, 176; 362/251; 315/291, 313, 314, 316, 363, 149, 294

(56) References Cited

U.S. PATENT DOCUMENTS 4,355,309 A * 10/1982 Hughey et al. ..... 340/825.53
5,189,412 A * 2/1993 Mehta et al. ..... 340/825.22
5,198,798 A * 3/1993 Lietzow et al. ..... 340/539
5,352,957 A * 10/1994 Werner ..... 315/291
5,689,261 A * 11/1997 Mehta et al. ..... 341/173
6,174,073 B1 * 1/2001 Regan et al. ..... 362/251

* cited by examiner

*Primary Examiner*—Michael Horabik
*Assistant Examiner*—William Bangachon
(74) *Attorney, Agent, or Firm*—Rosenberg, Klein & Lee

(57) ABSTRACT

A wireless remote-controlled lighting system is composed of a remote controller module and a remote control receiver installed in each of at least one addressable light bulb. Each addressable light bulb has assigned thereto a unique address, which is stored in a memory at each bulb. The remote controller module is used to emit a remote control signal to be received by the remote control receiver, the address for which has been entered into the remote controller module by a user. Once it has been determined that a transmitted address code matches the unique address stored in one of the addressable light bulbs, the bulb will be triggered into the applicable on/off state responsive to a control code transmitted with the address code.

8 Claims, 4 Drawing Sheets

WIRELESS REMOTE CONTROL BULB DEVICE

FIELD OF THE INVENTION

The present invention relates to a wireless remote control device and, more particularly, to a wireless remote control bulb device capable of controlling bulbs to be turned on or off through wireless remote control way.

BACKGROUND OF THE INVENTION

In prior art, the switches for controlling bulbs are usually installed on the wall, and each switch can only control the bulb connected therewith. Except modifying the wiring of the power wires of bulbs, it is impossible to change the way of control. However, this engineering must spend much time and money, and thus is very cumbersome.

Along with continual progress of scientific technology, more and more people emphasize the convenience and swiftness of lives. The present invention aims to let people be capable of flexibly controlling each bulb. Moreover, the present invention aims to let handicapped people be capable of controlling the action of each bulb through wireless remote control way without the need of other's help. Speaking briefly, the present invention provides a wireless remote control device to control bulbs to be turned on or off so as to achieve convenient use.

SUMMARY AND OBJECTS OF THE PRESENT INVENTION

The primary object of the present invention is to provide a wireless remote control device capable of controlling each bulb to be turned on or off through wireless remote control way. It is not necessary to connect each bulb to a switch on the wall via a connection wire. Therefore, very convenient use can be achieved. Moreover, the look of each bulb will not be influenced so that the original fabrication mold and fabrication process can be followed to reduce the cost.

Another object of the present invention is to provide a wireless remote control device for controlling bulbs so that each bulb can be remotely controlled, and a plurality of bulbs can be controlled to act simultaneously. Thereby, the on or off states of bulbs can be zoned or grouped to achieve convenience and flexibility in management.

Yet another object of the present invention is to provide a wireless remote control device for controlling bulbs, which device can be connected to a computer system. Thereby, the bulbs can be remotely controlled at a long distance or via the network.

According to the present invention, a wireless remote control bulb device comprises a remote controller module for emitting a remote control signal to be received by at least a remote control receiver installed in a bulb. The bulb is then driven after the signal is unmistakably discriminated. Thereby, the device can control the on or off states of more than one bulb through wireless remote control way.

The various objects and advantages of the present invention will be more readily understood from the following detailed description when read in conjunction with the appended drawings, in which:

DETAILED DESCRIPTION OF PREFERRED EMBODIMENT

According to the present invention, a wireless remote control bulb device comprises a wireless remote controller module for emitting a remote control signal to be received by a remote control receiver installed in a bulb. The bulb is then driven after the signal is unmistakably discriminated. Thereby, the user can control the on or off states of at least one bulb through wireless remote control way.

Figure 1:
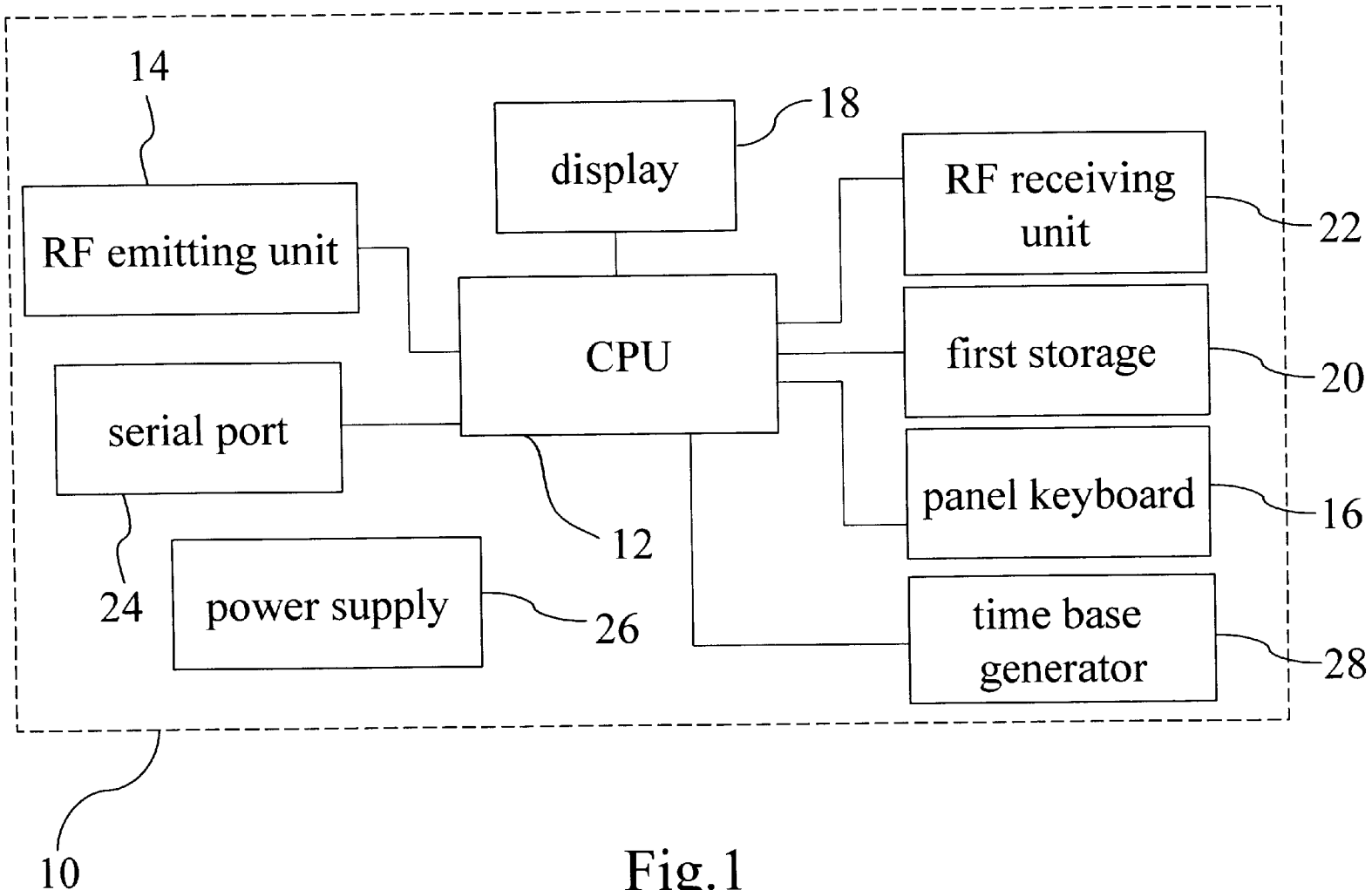
FIG. 1 is a block diagram of a remote controller module of the present invention.
Figure 2:
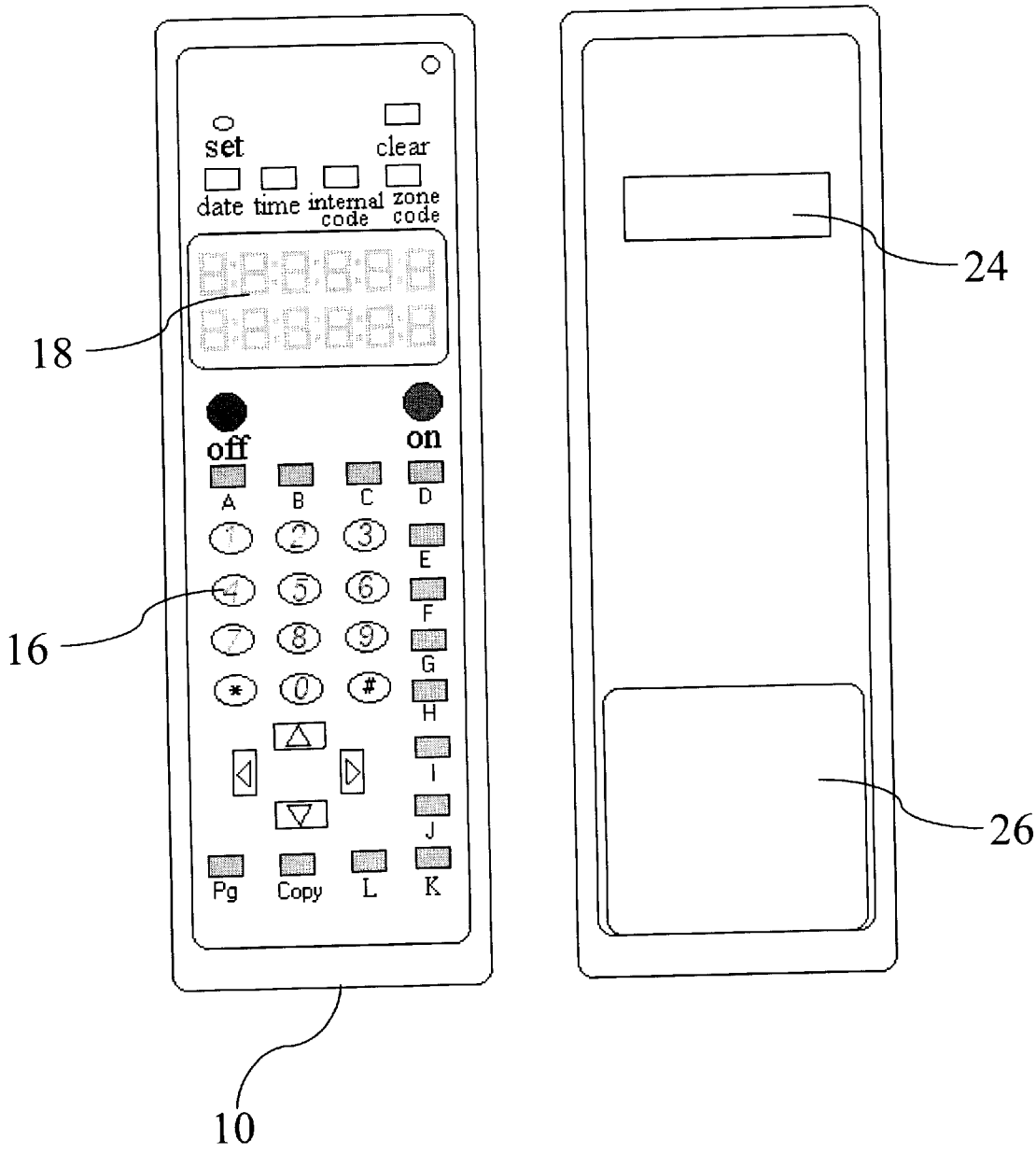
FIG. 2 is a schematic view of a remote controller module of the present invention.

As shown in FIGS. 1 and 2, a remote controller module 10 comprises a central processing unit (CPU) 12, a radio-frequency (RF) emitting unit 14, a panel keyboard 16, a display 18, a first storage 20, an RF receiving unit 22, a serial port 24, and a time base generator 28. The CPU is respectively connected to the RF emitting unit 14, the panel keyboard 16, the display 18, the first storage 20, the RF receiving unit 22, the serial port 24, and the time base generator 28. The CPU 12 is used to receive keyed-in data from the panel keyboard 16 and the remote control serial codes and zone codes of the bulbs the user wants to control so that the remote control receiver can receive them for learning and discriminating. The remote controller module 10 also displays the codes on the display 18 and stores them in the first storage 20. The CPU 12 transfers a remote control code to the RF emitting unit 14, which will then emit a remote control signal to set the remote control receiver. The RF receiving unit 22 connected to the CPU 12 is used to receive and copy data transferred from another remote controller module. The serial port 24 is a connector for the connection of the remote controller module 10 to external digital systems such as computer systems so that the object of controlling bulbs at a long distance or via the network can be achieved. The time base generator 28 is used to generate a reference time required for calculating date and time. The user can set in advance the time to turn on of off the bulbs. The CPU 12 will be driven to control the on or off states of bulbs once the set time has arrived. A power supply 26, generally being a battery set, is used to provide electricity for each of the above components.

Figure 3:
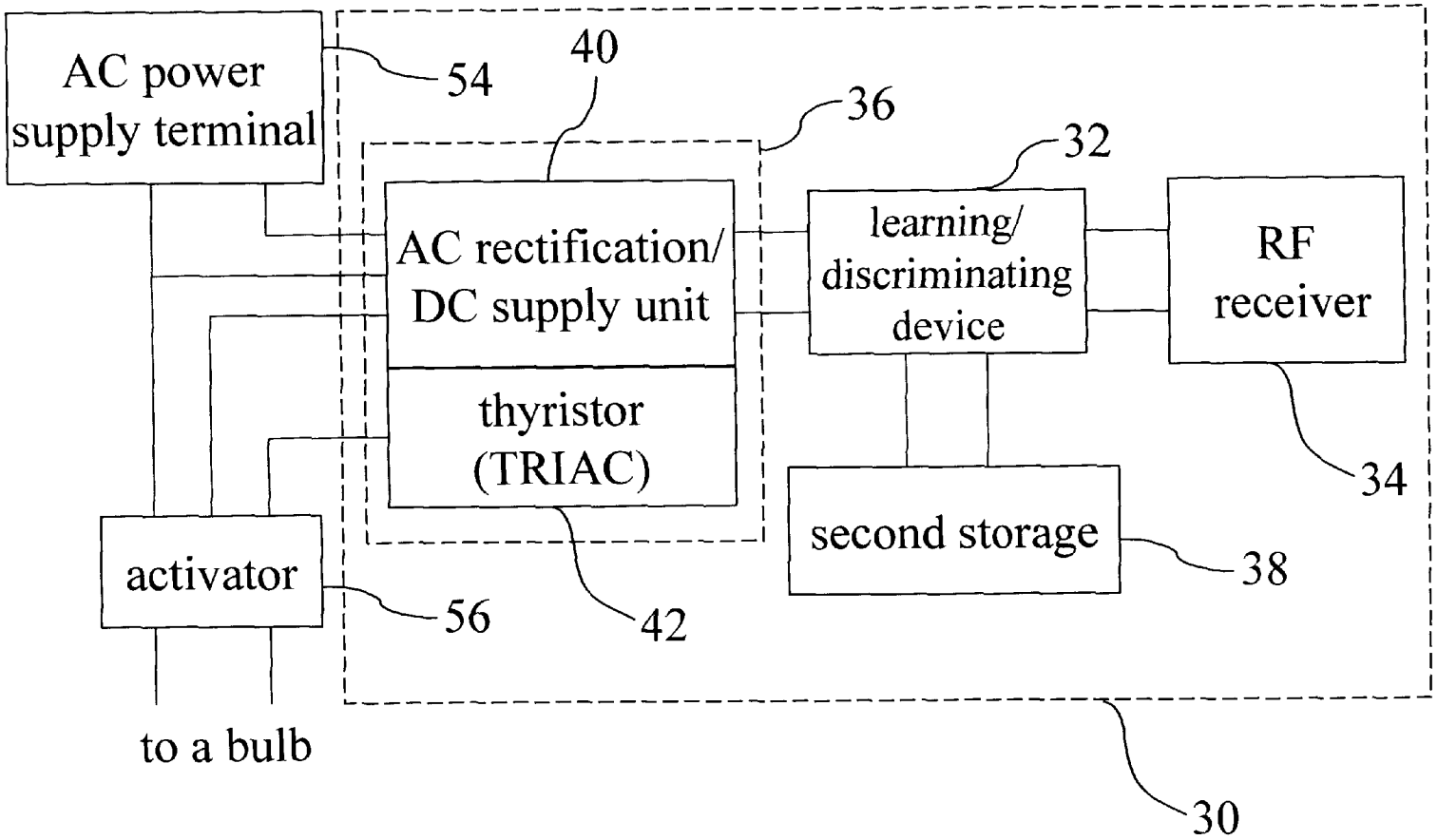
FIG. 3 is a block diagram of a remote control receiver of the present invention.
Figure 4:
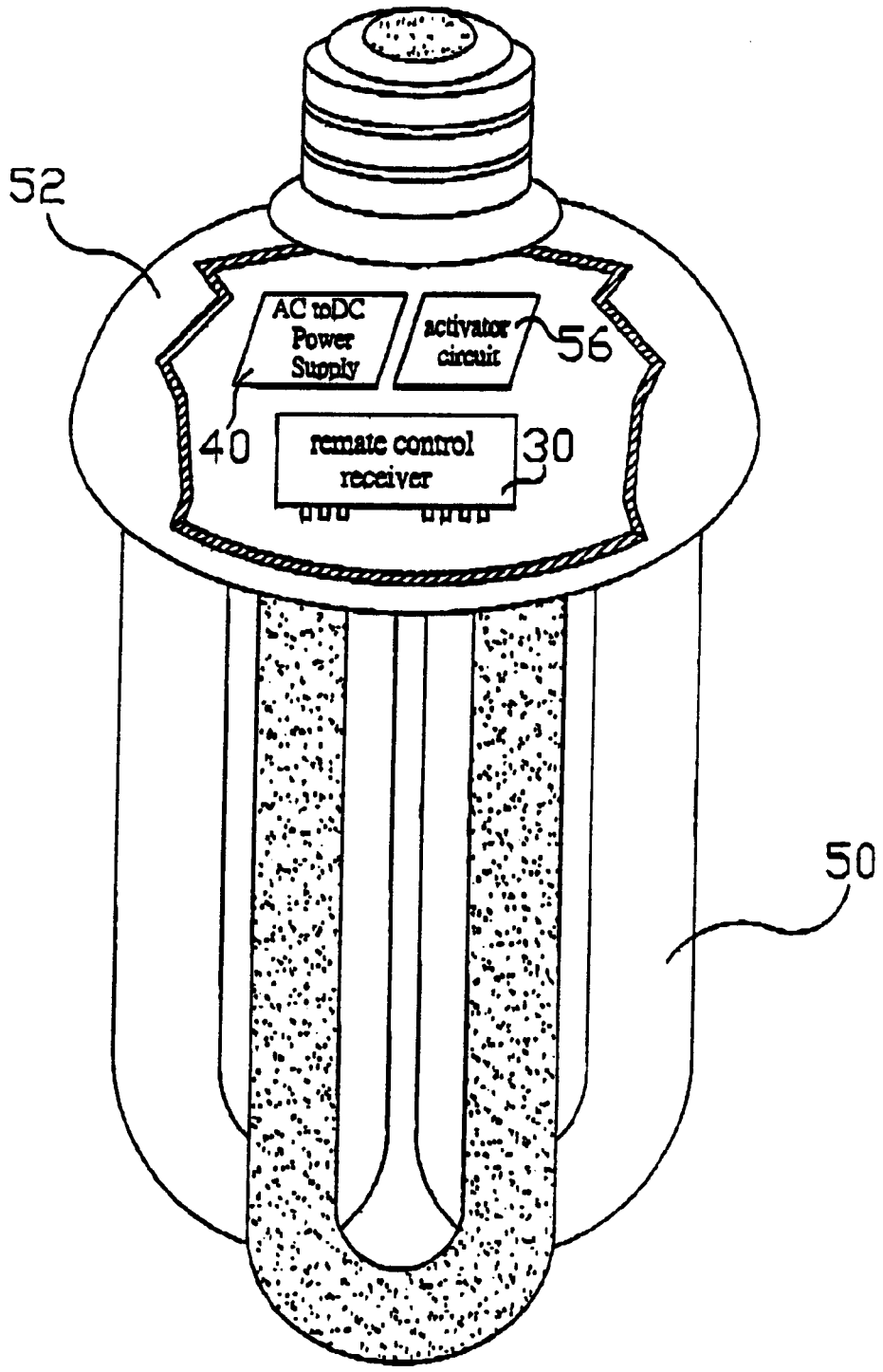
FIG. 4 is a schematic view after a remote control receiver of the present invention is installed in a bulb.

As shown in FIGS. 3 and 4, a remote control receiver 30 is installed in the holder 52 of a bulb 50. The remote control receiver 30 comprises a learning/discriminating device 32, an RF receiver 34, a DC power supply 36, and a second storage 38. The learning/discriminating device 32 is respectively connected to the RF receiver 34, the DC power supply 36, and the second storage 38. The RF receiver 34 is used to receive the remote control signal emitted from the remote controller module 10. The received remote control signal is then discriminated and compared by the learning/discriminating device 32 to see whether the remote control code is correct. The RF receiver 34 can also stores the received remote control code in the second storage 38. The second storage 38 stores the internal serial code of the remote control receiver 30 itself for comparing. After the received remote control code is unmistakably discriminated by the learning/discriminating device 32, a confirmation signal is transferred to a thyristor (TRIAC) 42 in the DC power supply 36. The TRIAC 42 is an AC control switch with two ends thereof respectively connected to an AC power supply terminal 54 in the bulb and an activator 56 of the bulb. If a remote control signal of the wireless remote control bulb device is received, the remote control receiver 30 will open or close the AC power connected to the bulb to let the bulb be turned on or off. The DC power supply 36 further comprises an AC rectification/DC supply unit 40 connected to the AC power supply terminal 54 in the bulb for transforming AC power into DC power to provide electricity for each component in the remote control receiver 30.

The above first storage 20 and second storage 38 are electrically erasable programmable read-only memories (EEPROMs).

Before the present invention is used, the serial codes and zone codes of the bulbs to be controlled must be keyed in via the panel keyboard of the remote controller module. The codes are then emitted by the RF emitting unit and then received by the RF receiver in the remote control receiver. Next, the received serial codes are transferred to the learning/discriminating device to be learned and memorized there and then stored in the second storage. Thereby, the remote controller module can remotely control at least a remote control receiver that has learned and been set beforehand to control the action of at least a bulb.

Because independent remote control needs independent addressing way, the remote control receiver of the present invention in each bulb has a unique addressing way of serial code to be learned and copied by the remote controller module. Therefore, each remote controller module not only can control a bulb independently, but also can control several tens of bulbs through learning. The same key can be set to a zone code in the remote controller module so that a plurality of bulbs can be controlled to be turned on or off simultaneously.

To sum up, the present invention provides a wireless remote control bulb device to control the on or off states of bulbs through wireless remote control way. It is not necessary to connect each bulb to a fixed switch on the wall via a connection wire, resulting in very convenient use. Moreover, because the remote control receiver is installed in the bulb, the look of each bulb will not be influenced so that the original fabrication mold and fabrication process can be followed to reduce the cost. Additionally, the present invention can achieve the effect of remote controlling the bulbs at a long distance via a telephone line or the network so that the on or off states of the bulbs can be zoned or grouped to acquire convenience and flexibility in management.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. A wireless remote-control lighting system comprising:

at least one addressable light bulb, each of which including:

a unique address code;

a lighting element; and a base portion incommutably coupled to said lighting element and being displaceable from said wireless remote-control lighting system, said base portion including:

a receiver for receiving an electromagnetic signal transmitted wirelessly thereto, said electromagnetic signal including a control code and an identifying address code;

a learning/discriminating device coupled to said receiver for providing a confirmation signal responsive to said control code upon the determination that said identifying address code matches said unique address code;

a switching device coupled to said learning/discriminating device for selectively controlling electrical current responsive to said confirmation signal;

a storage device for storing said unique address code, said identifying address code and said control code; and a power converter for providing DC power to said receiver, said learning/discriminating device, said switching device, and said storage device from AC line power; and a remote controller module for encoding and transmitting said electromagnetic signal, said remote controller module including:

a central processing unit for controlling components of said wireless remote-controlled lighting system in accordance with user input, said user input including said identifying address code of a corresponding addressable light bulb and a control code for setting an on/off state of a corresponding addressable light bulb;

a display device for displaying said user input;

a data entry device for entering said user input;

a local storage device for storing said user input;

a transmitter for transmitting said electromagnetic signal to said at least one addressable light bulb; and a timer for automatically triggering the transmission of said electromagnetic signal to said at least one addressable light bulb at a user-selected time.

2. The wireless remote-controlled lighting system as recited in claim 1, wherein said electromagnetic signal is a radio frequency signal.

3. The wireless remote-controlled lighting system as recited in claim 1, wherein said switching device is a triac.

4. The wireless remote-controlled lighting system as recited in claim 1, wherein said storage device in said at least one addressable light bulb and said local storage device in said remote controller module are electrically erasable programmable read-only memories.

5. The wireless remote-controlled lighting system as recited in claim 1, wherein said data entry device includes a keyboard.

6. The wireless remote-controlled lighting system as recited in claim 1, wherein said data entry device includes a serial communications port for entering said user input from an external digital device.

7. The wireless remote-controlled lighting system as recited in claim 1, wherein said data entry device includes a receiver for entering said user input from another remote controller module via a wireless link.

8. The wireless remote-controlled lighting system as recited in claim 1, wherein said base portion is threaded.

* * * * *